US009630190B2

(12) United States Patent
Lin et al.

(10) Patent No.: US 9,630,190 B2
(45) Date of Patent: Apr. 25, 2017

(54) MULTI-FUNCTION WATER OUTPUT DEVICE

(71) Applicant: Xiamen Runner Industrial Corporation, Xiamen (CN)

(72) Inventors: Xian-hai Lin, Xiamen (CN); Xi-min Chen, Xiamen (CN); Rong-gui Zhang, Xiamen (CN)

(73) Assignee: XIAMEN RUNNER INDUSTRIAL CORPORATION, Xiamen (CN)

( * ) Notice: Subject to any disclaimer, the term of this patent is extended or adjusted under 35 U.S.C. 154(b) by 21 days.

(21) Appl. No.: 14/962,579

(22) Filed: Dec. 8, 2015

(65) Prior Publication Data

US 2016/0186416 A1 Jun. 30, 2016

(30) Foreign Application Priority Data

Dec. 25, 2014 (CN) ..... 2014 2 0830157 U

(51) Int. Cl.

| | |
|---|---|
| ***B67D 7/06*** | (2010.01) |
| ***B05B 1/12*** | (2006.01) |
| ***E03C 1/04*** | (2006.01) |

(52) U.S. Cl.

CPC ..... *B05B 1/12* (2013.01); *E03C 1/0404* (2013.01)

(58) Field of Classification Search

CPC ..... B05B 1/12; B05B 1/18; E03C 1/0404
USPC ..... 222/144.5; 4/675–678; 239/525, 528, 239/529, 548; 137/315.13, 315.25, 801
See application file for complete search history.

(56) References Cited

U.S. PATENT DOCUMENTS

| | | | | |
|---|---|---|---|---|
| 6,093,313 | A * | 7/2000 | Bovaird | B01D 35/04 137/551 |
| 7,854,401 | B2 * | 12/2010 | Malek | B05B 1/1618 137/801 |
| 8,152,078 | B2 * | 4/2012 | Jianglin | B05B 1/1618 137/862 |
| 8,800,893 | B2 * | 8/2014 | Malek | B05B 1/1618 239/447 |
| 9,151,404 | B2 * | 10/2015 | Zhou | B05B 1/1609 |
| 2004/0227014 | A1 * | 11/2004 | Williams | B05B 1/1618 239/443 |
| 2008/0067264 | A1 * | 3/2008 | Erickson | B05B 1/1618 239/445 |
| 2011/0088784 | A1 * | 4/2011 | Meehan | E03C 1/0404 137/1 |
| 2016/0090720 | A1 * | 3/2016 | Chen | E03C 1/04 137/625.18 |
| 2016/0146358 | A1 * | 5/2016 | Lin | E03C 1/04 137/607 |

* cited by examiner

*Primary Examiner* — Lien Ngo
(74) *Attorney, Agent, or Firm* — Chun-Ming Shih

(57) ABSTRACT

A multi-function water output device includes: a shell, a water ejection head and a core body connected to each other in the shell. On the core body is provided with a first valve hole, a second valve hole, and a third valve hole disposed in sequence along a water flow direction from rear to front. Rear end of the core body is provided with an outer interface, while inside the outer interface is provided with an inner interface. An inner cavity of the inner interface is in communication with a first water input port at bottom of a first valve hole. An upper portion of the first valve hole is provided with first water output port. In the first valve hole is provided with a first valve plug, controlling connection and disconnection of the first water input port and the first water output port.

4 Claims, 2 Drawing Sheets

MULTI-FUNCTION WATER OUTPUT DEVICE

BACKGROUND OF THE INVENTION

Field of the Invention

The present invention relates to a water output device, and in particular to a multi-function water output device.

The Prior Arts

Presently, faucet in kitchen can only output one kind of water, namely faucet water. To meet the requirement of purified water utilized quite often in kitchen, a faucet for purified water has to be added. However, by doing so, it could increase equipment cost and occupy additional space.

Therefore, presently, the design and performance of water output device is not quite satisfactory, and they leave much room for improvement.

SUMMARY OF THE INVENTION

In view of the problems and drawbacks of the prior art, the present invention provides a multi-function water output device, that is compact in structure, and is able to provide two kinds of output water, to overcome the shortcomings of the prior art.

The multi-function water output device includes: a shell, a water ejection head and a core body connected to each other in the shell. On the core body is provided with a first valve hole, a second valve hole, and a third valve hole disposed in sequence along a water flow direction from rear to front. A rear end of the core body is provided with an outer interface connected to a water input tube, while inside the outer interface is provided with an inner interface. An inner cavity of the inner interface is in communication with a first water input port at bottom of a first valve hole. An upper portion of the first valve hole is provided with first water output port. In the first valve hole is provided with a first valve plug, controlling connection and disconnection of the first water input port and the first water output port. The first water output port is connected to the first water ejection hole on a water ejection head via a channel on a side of the core body. A ring-shape water input port between the inner interface and the outer interface is connected and in communication with a second water input port on the bottom portion of the second valve hole via a channel on the other side of the core body. The second water output port on the upper portion of the second valve hole is connected and in communication with a third water input port in a central portion of a third valve hole. In the second valve hole is provided with a second valve plug, controlling connection and disconnection of the second water input port and the second water output port. The third valve hole is connected to the second water ejection hole or the third water ejection hole on the water ejection head depending on actual requirement.

On an upper portion of the third valve hole is provided with a third water output port A connected and in communication with the second water ejection hole on the water ejection head; while on a lower portion of the third valve hole is provided with a third water output port B connected and in communication with the third water ejection hole on the water ejection head; and in the third valve hole is provided with a third valve plug controlling the connection and communication of the third water input port to the third water output port A or the third water output port B.

An interlocking connection rod is hinged and connected between the first valve plug and the second valve plug, such that one end of the interlocking connection rod is fastened to the lower portion of a head of the first valve plug, while its other end is fastened to the lower portion of a head of the second valve plug, to prevent the open or close of the first valve plug and the second valve plug at the same time.

The bottoms of the first valve plug, the second valve plug, and the third valve plug are each provided with a restoring spring. On the shell is provided with a first push button located above the first valve plug, while on the shell is also provided with a second push button disposed laterally above the second valve plug and the third valve plug. A center of a lower side of the second push button is hinged and connected on the core body, and an L-shape hook is disposed at a front lower portion of the second push button, such that a lateral hook portion of the L-shape hook is fastened into the lower portion of a head of the third valve plug.

Compared with the present technology, the multi-function water output device of the present invention has the following advantages: novel in design, compact in structure, low in production cost, in fulfilling the demand of two water outputs, thus having a good prospect on the market.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from the detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed description with reference to the attached drawings.

Figure 1:
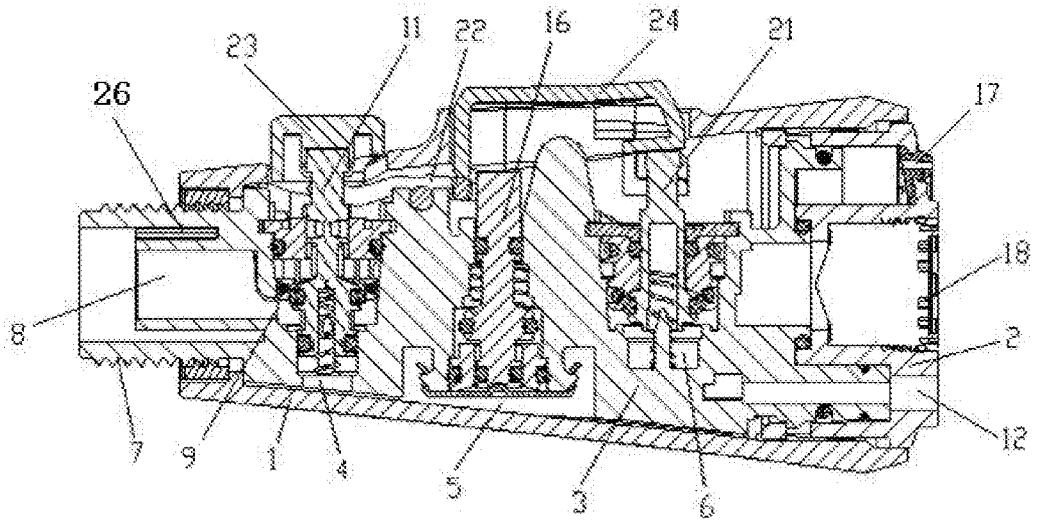
FIG. 1 is a cross section view of a multi-function water output device in a first water output condition according to the present invention.
Figure 2:
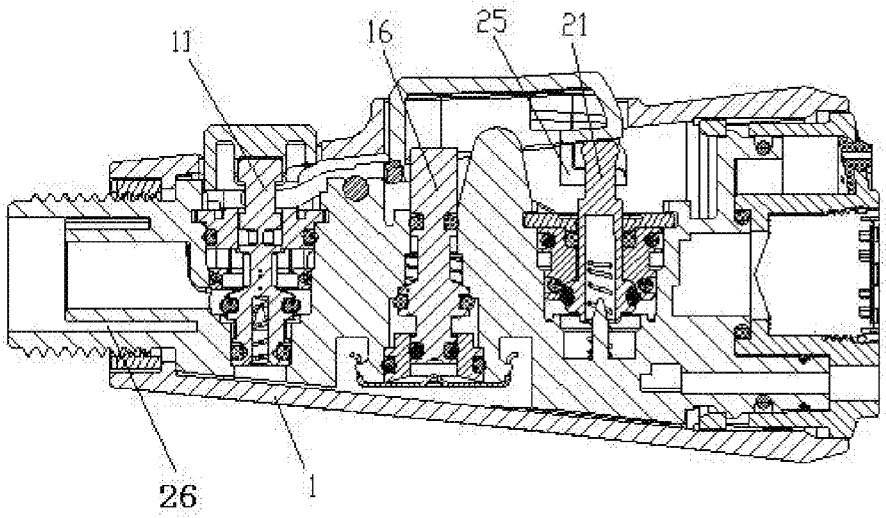
FIG. 2 is a cross section view of a multi-function water output device in a second water output condition according to the present invention.
Figure 3:
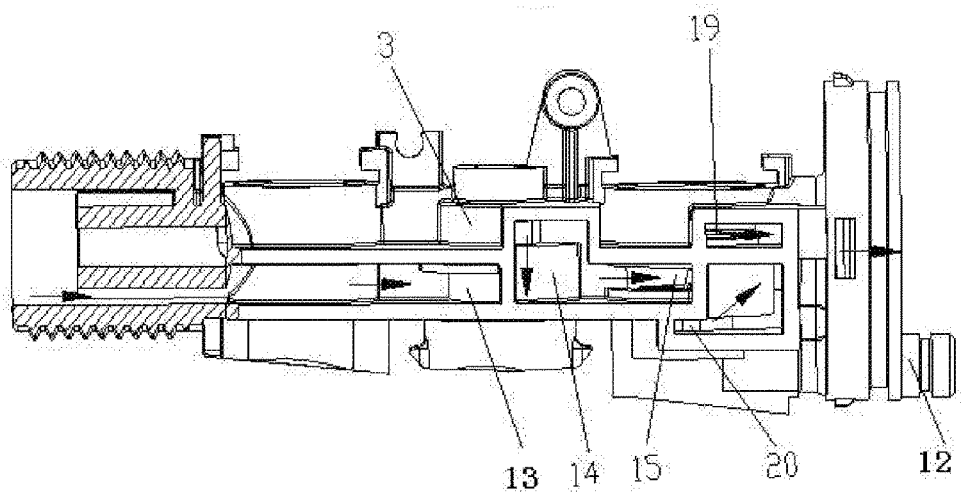
FIG. 3 is a front perspective view of a core body according to the present invention.
Figure 4:
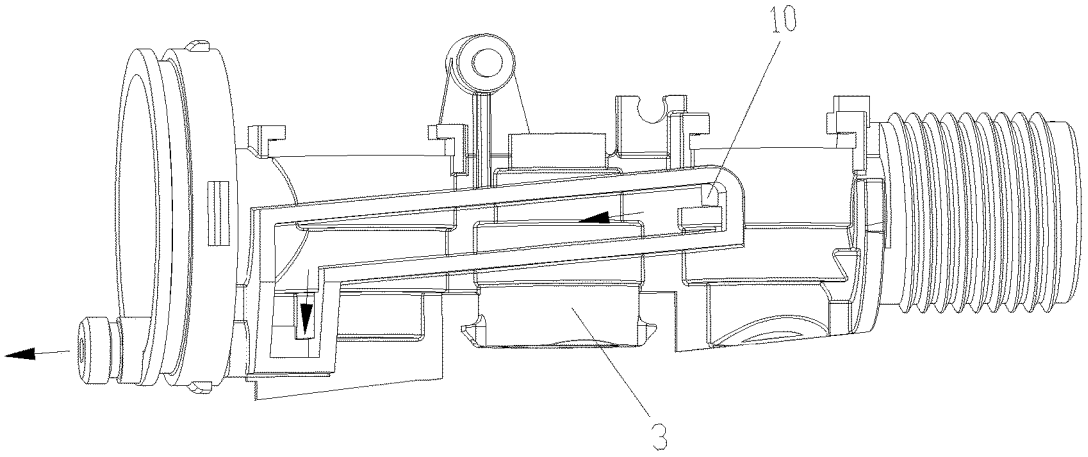
FIG. 4 is a rear perspective view of a core body according to the present invention.

Refer to FIGS. 1 to 4 respectively for a cross section view of a multi-function water output device in a first water output condition according to the present invention; a cross section view of a multi-function water output device in a second water output condition according to the present invention; a front perspective view of a core body according to the present invention; and a rear perspective view of a core body according to the present invention.

As shown in FIGS. 1 to 4, the multi-function water output device includes: a shell 1, a water ejection head 2 and a core body 3 connected to each other in the shell 1. On the core body 3 is provided with a first valve hole 4, a second valve hole 5, and a third valve hole 6 disposed in sequence along a water flow direction from rear to front. A rear end of the core body 3 is provided with an outer interface 7 connected to a water input tube, while inside the outer interface 7 is provided with an inner interface 8. An inner cavity of the inner interface 8 is in communication with a first water input port 9 at bottom of a first valve hole 4. An upper portion of the first valve hole 4 is provided with first water output port 10. In the first valve hole 4 is provided with a first valve plug 11, controlling connection and disconnection of the first water input port 9 and the first water output port 10. The first water output port 10 is connected to the first water ejection hole 12 on a water ejection head 2 via a channel on a side of the core body 3. The first flow body flows into the first valve hole 4 via the inner cavity of the inner interface 8, then it is ejected from the first water ejection hole 12 of the water ejection head 2. The first flow body can be purified water obtained through filtering.

A ring-shape water input port 26 between the inner interface 8 and the outer interface 7 is connected and in communication with a second water input port 13 on the bottom portion of the second valve hole 5 via a channel on the other side of the core body 3. The second water output port 14 on the upper portion of the second valve hole 5 is connected and in communication with a third water input port 15 in a central portion of the third valve hole 6. In the second valve hole 5 is provided with a second valve plug 16, controlling connection and disconnection of the second water input port 13 and the second water output port 14. The third valve hole 6 is connected to the second water ejection hole 17 or the third water ejection hole 18 on and the water ejection head 2 depending on actual requirement.

The second water ejection hole 17 is used for shower water ejection, while the third water ejection hole 18 is used for concentrated water ejection. In this case, the second flow body flows into the second valve hole 5 via the ring-shape water input port 26 between the outer interface 7 and the inner interface 8, then it is ejected out of the first water ejection hole 12 or the second water ejection hole 17 on the water ejection head 2. The second flow body mentioned above can be faucet water without going through filtering.

In the present embodiment, on an upper portion of the third valve hole 6 is provided with a third water output port A (19) connected and in communication with the second water ejection hole 17 on the water ejection head 2; while on a lower portion of the third valve hole 6 is provided with a third water output port B (20) connected and in communication with the third water ejection hole 18 on the water ejection head 2. In the third valve hole 6 is provided with a third valve plug 21 controlling the connection and communication of the third water input port 15 to the third water output port A (19) or the third water output port B (20). As such, when the third valve plug 21 moves downward, the third water input port 15 and the third water output port A (19) are connected and in communication. When the third valve plug 21 moves upward, the third water input port 15 and the third water output port B (20) are connected and in communication. Through the upward and downward movement of the third valve plug 21, the water output of the second flow body can be switched.

In the present embodiment, an interlocking connection rod 22 is hinged and connected between the first valve plug 11 and the second valve plug 16, such that one end of the interlocking connection rod 22 is fastened to the lower portion of a head of the first valve plug 11, while its other end is fastened to the lower portion of a head of the second valve plug 16, to prevent the open or close of the first valve plug 11 and the second valve plug 16 at the same time. Therefore, when the first valve plug 11 moves downward, the first valve hole is opened, the first water input port 9 and the first water output port 10 are connected and in communication. At the same time, the second valve plug 16 moves upward, the second valve hole is closed. When the second valve plug 16 moves downward, the second valve hole 5 is opened, the second water input port 13 and the second water output port 14 are connected and in communication. At the same time, the first valve plug 11 moves upward, the first valve hole 4 is closed. As such, the water ejection head 2 ejects only one of the first flow body and the second flow body, while the third valve plug 21 is used to switch the water output of the second flow body.

The bottoms of the first valve plug 11, the second valve plug 16, and the third valve plug 21 are each provided with a restoring spring. When the first valve plug 11 or the second valve plug 16 moves downward, it is able to keep moving downward due to water pressure. On the shell 1 is provided with a first push button 23 located above the first valve plug 11, while on the shell 1 is also provided with a second push button 24 disposed laterally above the second valve plug 16 and the third valve plug 21. The center of a lower side of the second push button 24 is hinged and connected on the core body 3, and an L-shape hook 25 is disposed at a front lower portion of the second push button 24, such that the lateral hook portion of the L-shape hook 25 is fastened into the lower portion of a head of the third valve plug 21. When pressing downward the rear end of the second push button 24, the second valve plug 16 moves downward, at the same time the third valve plug 21 moves upward. In case it is desired to switch water output, then press the front end of the second push button 24, such that the third valve plug 21 moves downward. The second valve plug 16 will keep moving downward due to water pressure, to keep the second valve hole 5 open.

Through the application of the present invention, two separate flow bodies can be switched to flow in separate channels, to avoid cross flow between the two flow bodies, while its structure is compact and it is easy to control.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A multi-function water output device, comprising:

a shell;

a water ejection head, disposed in the shell; and a core body, disposed in the shell, wherein the core body is connected to the water ejection head, on the core body is provided with a first valve hole, a second valve hole, and a third valve hole disposed in sequence along a water flow direction from rear to front, a rear end of the core body is provided with an outer interface connected to a water input tube, while inside the outer interface is provided with an inner interface, an inner cavity of the inner interface is in communication with a first water input port at bottom of a first valve hole, an upper portion of the first valve hole is provided with first water output port, in the first valve hole is provided with a first valve plug, controlling connection and disconnection of the first water input port and the first water output port, the first water output port is connected to a first water ejection hole on the water ejection head via a channel on a side of the core body, a ring-shape water input port between the inner interface and the outer interface is connected and in communication with a second water input port on the bottom portion of the second valve hole via a channel on the other side of the core body, the second water output port on the upper portion of the second valve hole is connected and in communication with a third water input port in a central portion of a third valve hole, in the second valve hole is provided with a second valve plug, controlling connection and disconnection of the second water input port and the second water output port, and a third valve hole is connected and in communication with a second water ejection hole or a third water ejection hole on the water ejection head.

2. The water output device as claimed in claim 1, wherein on an upper portion of the third valve hole is provided with a third water output port A connected and in communication with the second water ejection hole on the water ejection head; while on a lower portion of the third valve hole is provided with a third water output port B connected and in communication with the third water ejection hole on the water ejection head; and in the third valve hole is provided with a third valve plug controlling the connection and communication of the third water input port to the third water output port A or the third water output port B.

3. The water output device as claimed in claim 1, wherein an interlocking connection rod is hinged and connected between the first valve plug and the second valve plug, such that one end of the interlocking connection rod is fastened to the lower portion of a head of the first valve plug, while its other end is fastened to the lower portion of a head of the second valve plug, to prevent the open or close of the first valve plug and the second valve plug at the same time.

4. The water output device as claimed in claim 3, wherein bottoms of the first valve plug, the second valve plug, and the third valve plug are provided each with a restoring spring, on the shell is provided with a first push button located above the first valve plug, while on the shell is also provided with a second push button disposed laterally above the second valve plug and the third valve plug, a center of a lower side of the second push button is hinged and connected on the core body, and an L-shape hook is disposed at a front lower portion of the second push button, such that a lateral hook portion of the L-shape hook is fastened into the lower portion of a head of the third valve plug.

* * * * *